US007205470B2

(12) United States Patent
Tsukamoto et al.

(10) Patent No.: US 7,205,470 B2
(45) Date of Patent: Apr. 17, 2007

(54) PLAY DATA EDITING DEVICE AND METHOD OF EDITING PLAY DATA

(75) Inventors: Kaoru Tsukamoto, Tokyo (JP); Tomohiro Iwanaga, Tokyo (JP); Hiroto Miyahara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 166 days.

(21) Appl. No.: 11/075,689

(22) Filed: Mar. 10, 2005

(65) Prior Publication Data

US 2005/0150360 A1 Jul. 14, 2005

(30) Foreign Application Priority Data

May 24, 2004 (JP) ..... 2004-152922

(51) Int. Cl.
*G10H 7/00* (2006.01)
*G04B 13/00* (2006.01)

(52) U.S. Cl. ..... 84/609; 84/610; 84/611; 84/613; 84/634; 84/635; 84/637; 84/649

(58) Field of Classification Search ..... None
See application file for complete search history.

(56) References Cited

U.S. PATENT DOCUMENTS 5,905,223 A * 5/1999 Goldstein ..... 84/649

FOREIGN PATENT DOCUMENTS

JP 06-295179 10/1994
JP 2002-258841 9/2002

* cited by examiner

*Primary Examiner*—Marlon Fletcher
(74) *Attorney, Agent, or Firm*—Takeuchi & Kubotera, LLP

(57) ABSTRACT

A play data editing device edits play data according to a characteristic of a speaker. The play data editing device includes a dividing unit (301) for dividing first play data into second play data per channel; a classifying unit (302) for classifying the second play data into a rhythm part, a melody part, and a base part; a chord processing unit (303) for converting a number of chords of the second play data corresponding to the melody part according to the characteristic of the speaker; a velocity processing unit (304) for converting a velocity of the second play data corresponding to the rhythm part according to the characteristic of the speaker; and a sound range processing unit (305) for shifting a sound range of the second play data corresponding to the base part according to the characteristic of the speaker.

10 Claims, 4 Drawing Sheets

PLAY DATA EDITING DEVICE AND METHOD OF EDITING PLAY DATA

BACKGROUND OF THE INVENTION AND RELATED ART STATEMENT

The present invention relates to a play data editing device and a method of editing play data. More specifically, the present invention relates to a technology for editing play data such as Musical Instrument Digital Interface (MIDI), so that the play data is automatically adjusted according to a speaker characteristic of a melody playing device and the like.

A mobile communication terminal such as a cellular phone is typically provided with a melody playing function. The melody plying function is generally used for generating a ring tone upon receiving a call or an electrical mail. Some of the mobile communication terminals are known to have a capability of plying music.

Many of the mobile communication terminals are adopted MIDI as a standard of playing melody. Instead of converting sound to data, according to the MIDI standard, play information of an instrument is converted to data. For example, when the instrument is a keyboard, a playing action such as "pressing a keyboard with a finger", "releasing a finger from a keyboard", "pressing a pedal with a foot", "releasing a foot from a pedal", "changing a tone", and the like is converted to data. The play data corresponding to the MIDI standard is called MIDI data.

It is possible to create MIDI data with a personal computer, a MIDI device, and the like. For example, a MIDI keyboard is used for inputting information, and a personal computer edits the information to obtain MIDI data.

MIDI data can be played on an audio system as well as a mobile communication terminal. When a mobile communication terminal plays MIDI data edited for an audio system, however, audio quality tends to be deteriorated. This is because many of mobile communication terminals only have a small speaker. Normally, a mobile communication terminal has a small speaker with a diameter of 1.0 cm or less. In general, a small speaker has a characteristic in which a gain of low pitch sound is smaller than that of high pitch sound. Depending on a type of instrument, it may be difficult to play on a small speaker. Accordingly, when a mobile communication terminal plays MIDI data edited for a large speaker, it is necessary to edit the MIDI data. Patent References 1 and 2 have disclosed technologies for editing MIDI data.

Patent Reference 1 has disclosed a technology in which MIDI data is edited according to a difference in an instrument and a characteristic of a sound generator. In the technology, a sound conversion table includes a relationship between a set volume and an actual play volume according to an instrument, and MIDI data is edited based on the sound conversion table. In the technology of Patent Reference 1, it is possible to adjust only a volume balance depending on a difference in a sound generator, thereby making it difficult to adjust a property other than a volume. Accordingly, it is difficult to use the technology for converting MIDI data for a large speaker to MIDI data for a small speaker.

Patent Reference 2 has disclosed a technology in which accompaniment information is added to existing play data. In the technology, a central processing unit (CPU) detects a chord in play data using a chord table, and an automated accompaniment device creates accompaniment information corresponding to the chord. However, it is difficult to solve the problem associated with a small speaker described above by adding accompaniment.

Patent Reference 1; Japanese Patent Publication (Kokai) No. 2002-258841

Patent Reference 2; Japanese Patent Publication (Kokai) No. 06-295179

In view of the problems described above, an object of the present invention is to provide a play data editing device and a method of editing play data, in which it is possible to prevent deterioration of sound quality due to a difference in a speaker characteristic.

Further objects and advantages of the invention will be apparent from the following description of the invention.

SUMMARY OF THE INVENTION

In order to attain the objects described above, according to a first aspect of the present invention, a play data editing device converts play data to another play data corresponding to a characteristic of a specific speaker. The play data editing device includes a dividing unit for dividing first play data into second play data per channel; a classifying unit for classifying the second play data into a rhythm part, a melody part, and a base part; a chord processing unit for converting a number of chords of the second play data corresponding to the melody part according to a characteristic of a speaker; a velocity processing unit for converting a velocity of the second play data corresponding to the rhythm part according to the characteristic of the speaker; and a sound range processing unit for shifting a sound range of the second play data corresponding to the base part according to the characteristic of the speaker.

According to a second aspect of the present invention, a method of converting play data to another play data corresponding to a characteristic of a specific speaker includes the steps of dividing first play data into second play data per channel; classifying the second play data into a rhythm part, a melody part, and a base part; converting a number of chords of the second play data corresponding to the melody part according to a characteristic of a speaker; converting a velocity of the second play data corresponding to the rhythm part according to the characteristic of the speaker; and shifting a sound range of the second play data corresponding to the base part according to the characteristic of the speaker.

In the present invention, the second play data is classified into the rhythm part, the melody part, and the base part. Then, a number of processing types (the chord conversion process, the velocity conversion process, and the sound range shift) is determined based on the classification. Accordingly, it is possible to effectively edit the play data according to the characteristic of the speaker.

DETAILED DESCRIPTION OF PREFERRED EMBODIMENTS

Figure 1:
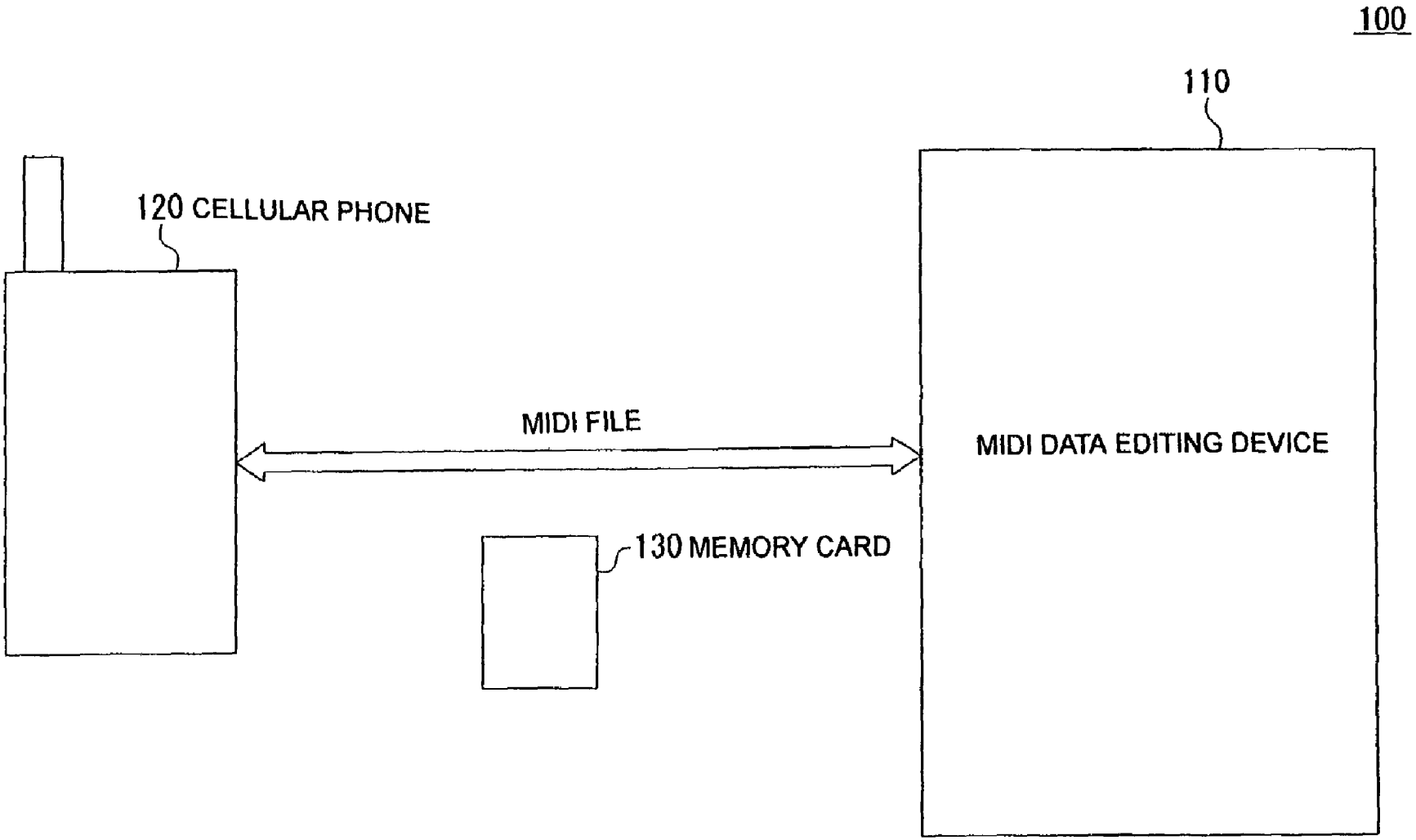
FIG. 1 is a schematic block diagram showing a structure of a system according to an embodiment of the present invention.

Hereunder, embodiments of the present invention will be explained with reference to the accompanying drawings. In the drawings, a size, a shape, and an arrangement of constituting elements are schematically shown for explanation of the present invention. Numerical conditions described in the following description are just an example.

As shown in FIG. 1, according to an embodiment of the present invention, a system 100 includes a MIDI data editing device 110 and a cellular phone 120. The MIDI data editing device 110 includes, for example, a personal computer. The MIDI data editing device 110 exchanges a MIDI file (file with MIDI data) with the cellular phone 120. A storage medium of a MIDI file includes a memory card and a data cable. In this embodiment, a memory card 130 is used.

Figure 2:
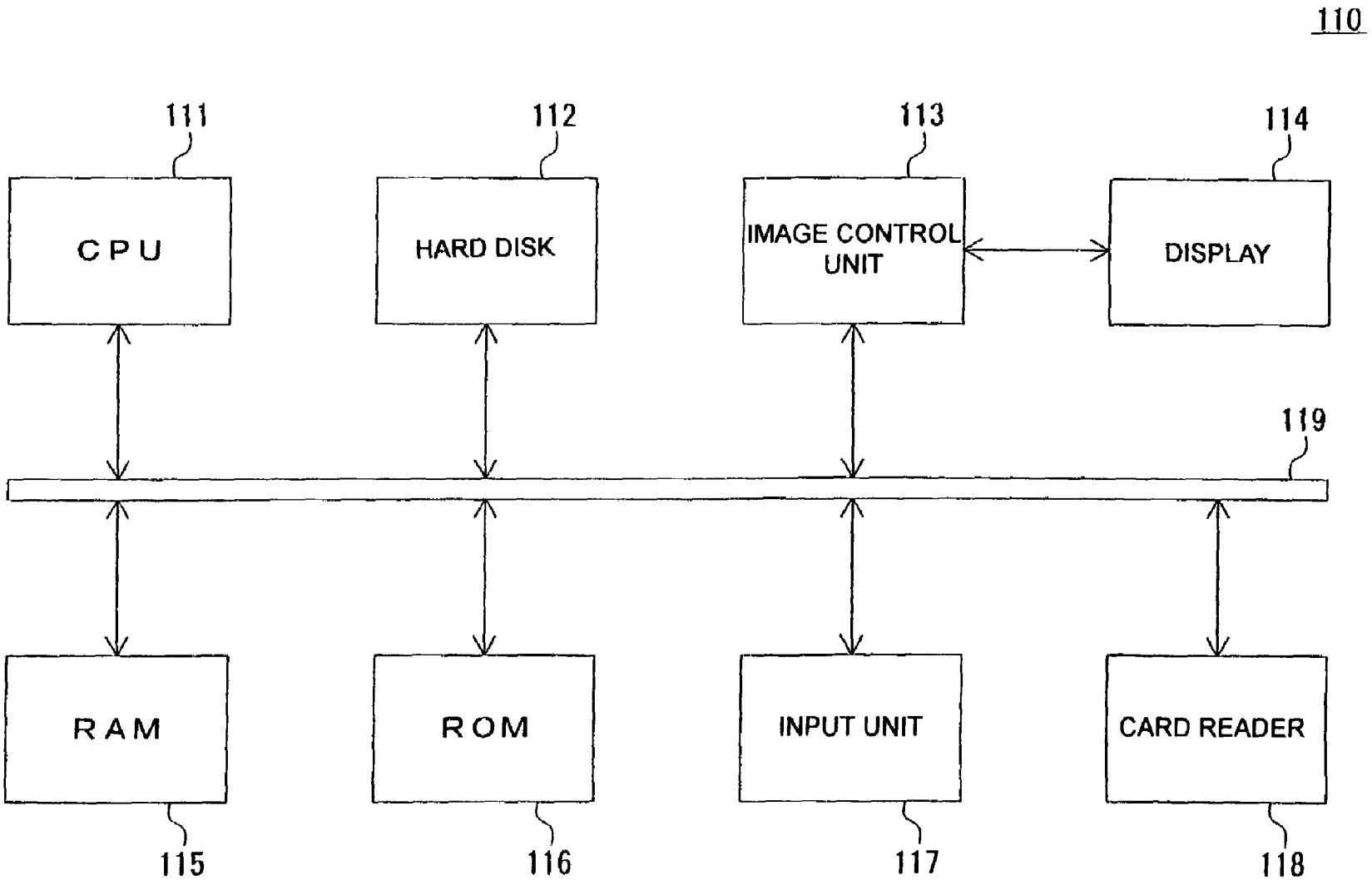
FIG. 2 is a schematic block diagram showing a structure of a play data editing device shown in FIG. 1.

As shown in FIG. 2, the MIDI data editing device 110 includes a central processing unit (CPU) 111, a hard disk 112, an image control unit 113, a display 114, a random access memory (RAM) 115, a read only memory (ROM) 116, an input unit 117, a card reader 118, and a data bus 119. The CPU 111 executes a MIDI data editing program, and controls the other components 112 to 118. The hard disk 112 stores an operating system, the MIDI data editing program, and the like. The image control unit 113 controls the display 114 to display an edition result of MIDI data and the like.

The RAM 115 is a semiconductor memory capable of reading and writing as a work area of the CPU 111. The ROM 116 is a non-volatile memory for storing a boot loader program to start up the operating system. The input unit 117 includes a keyboard and a mouse so that an operator operates the MIDI data editing device 110. The card reader 118 reads the MIDI file from the memory card 130 (see FIG. 1), and writes the MIDI file on the memory card 130 after editing. The data bus 119 is a wiring for connecting the components 111 to 113 and 115 to 118 with each other.

Figure 3:
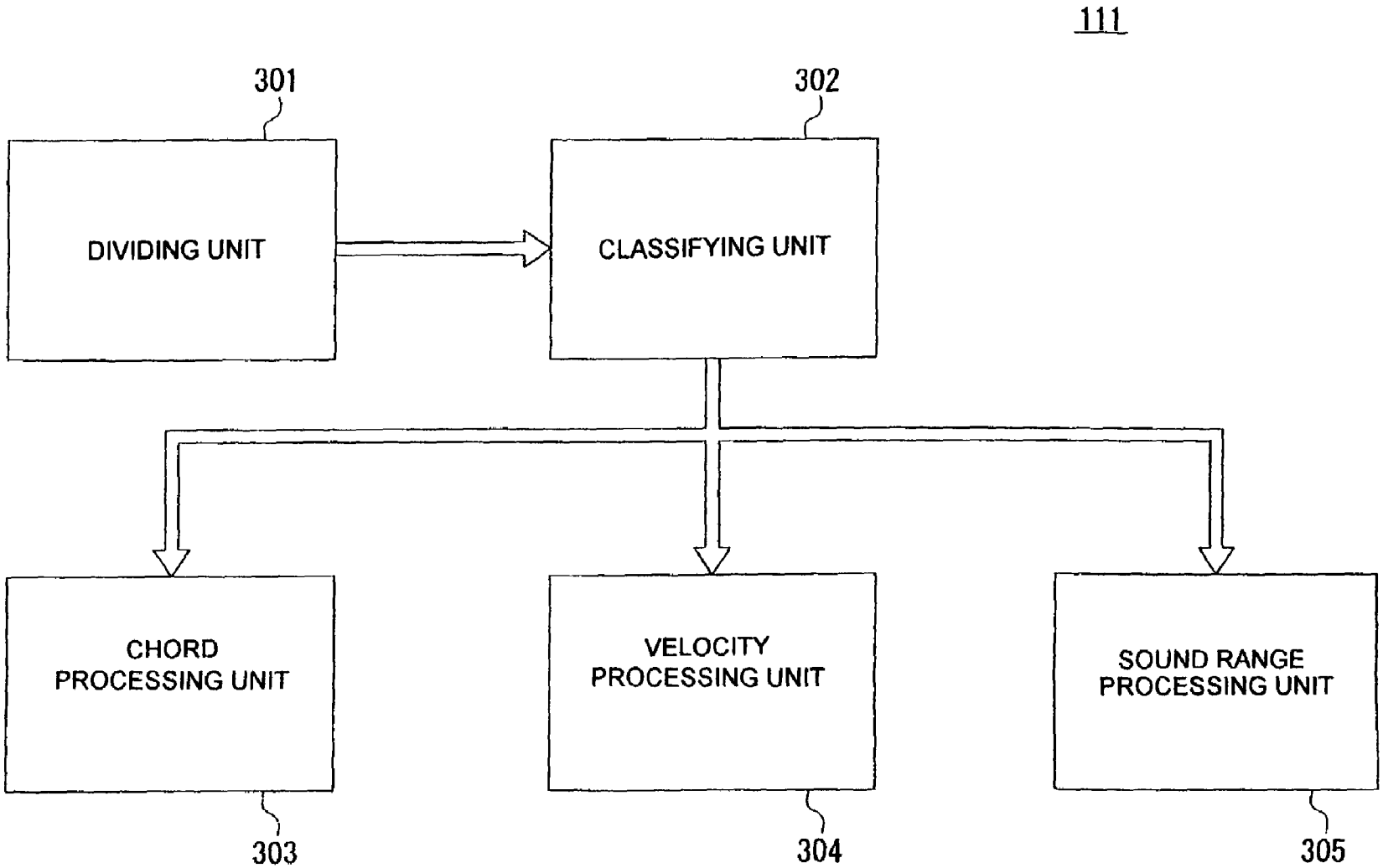
FIG. 3 is a schematic block diagram showing a functional structure of the play data editing device shown in FIG. 1.

As shown in FIG. 3, the CPU 111 includes a dividing unit 301; a classifying unit 302; a chord processing unit 303; a velocity processing unit 304; and a sound range processing unit 305. The dividing unit 301 divides MIDI data into a series of MIDI messages per channel. The classifying unit 302 classifies the series of the MIDI messages obtained in the dividing unit 301 into a rhythm part, a melody part, and a base part. The chord processing unit 303 converts a number of chords of the series of the MIDI messages corresponding to the melody part according to a characteristic of a speaker of the cellular phone 120.

The velocity processing unit 304 converts a velocity of the series of the MIDI messages corresponding to the rhythm part according to the characteristic of the speaker of the cellular phone 120. The sound range processing unit 305 shifts a sound range of the series of the MIDI messages corresponding to the base part according to the characteristic of the speaker of the cellular phone 120. The components 301 to 305 may be formed of hardware.

An operation of the system shown in FIGS. 1 to 3 will be explained next.

(1) When the MIDI data editing device 110 is turned on, the CPU executes the boot loader program stored in the ROM 116.

(2) When the boot loader program is executed, the operating system is sent from the hard disk 112 to the RAM 115 via the data bus 119, so that the operating system starts up.

(3) When the operating system is executed through an operation of an operator, a MIDI data editing program is sent from the hard disk 112 to the RAM 115 via the data bus 119, so that the MIDI data editing program starts up.

(4) When the MIDI data editing program is executed through an operation of the operator, the MIDI file is read from the memory card 130 retained in the card reader 118. The MIDI file is then sent to the RAM 115 via the data bus 119.

(5) With the MIDI data editing program through an operation of the operator, the MIDI data in the MIDI file is automatically edited (described later), and MIDI data after the edition is stored in the RAM 115.

(6) The CPU 111 controls the image control unit 113 to display information associated with the MIDI data after the edition on the display 114. The operator can check a result of the edition with the display 114, and can further change the result of the edition.

(7) With the MIDI data editing program through an operation of the operator, the MIDI file after the edition is sent from the RAM 115 to the memory card 130, thereby completing the process.

Figure 4:
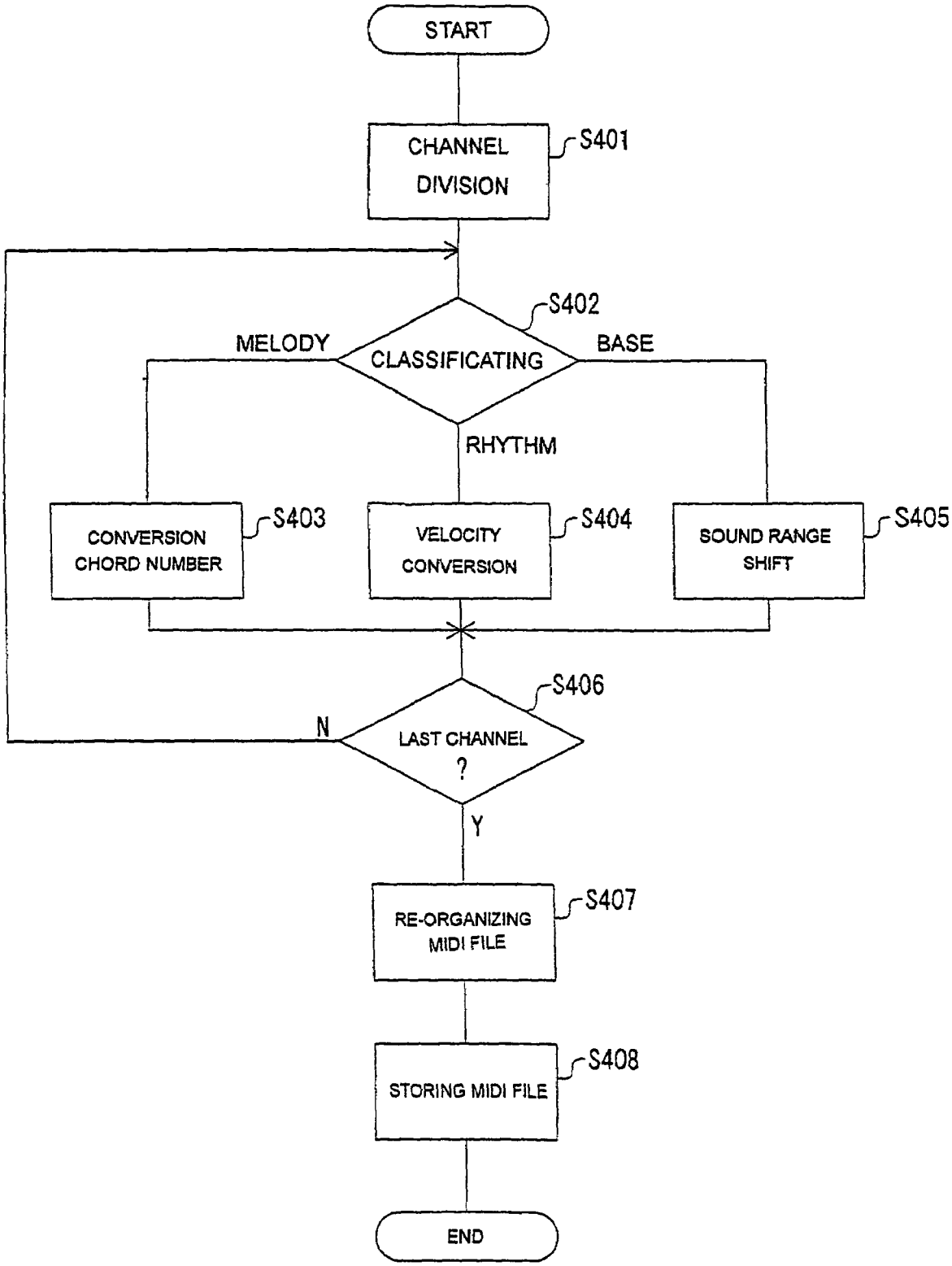
FIG. 4 is a flow chart showing a process of the play data editing device shown in FIG. 1.

FIG. 4 is a flow chart showing an editing process of the MIDI data editing program (see (5) described above). First, the dividing unit 301 sequentially reads the MIDI data from the RAM 115, and divides the MIDI data per channel (step S401). According to the general MIDI (GM), a MIDI sound generator has sixteen channels. A MIDI message in the MIDI data contains a channel number for playing the MIDI message. Accordingly, it is possible to divide the MIDI messages per channel by reading the channel number.

Then, the classifying unit 302 executes a process of classifying the series of the MIDI messages per channel into one of the rhythm part, the melody part, and the base part (step S402). In the process, first, it is determined that the series of the MIDI messages belongs to the rhythm part. According to the GM standard, the tenth channel is used for the rhythm part. Accordingly, the MIDI data editing program checks the channel number of the series of the MIDI messages. When the channel number is ten, it is determined that the series of the MIDI messages is the rhythm part.

When the series of the MIDI messages is not the rhythm part, the classifying unit 302 determines a type of instrument corresponding to the series of the MIDI messages. According to the GM standard, 128 types of instruments are defined for the MIDI sound generator. In the embodiment, the instruments are divided into melody instruments (likely to be used in the melody part), base instruments (likely to be used in the base part), and other instruments. Accordingly, when the melody instruments are assigned, the series of the MIDI messages belongs to the melody part. When the base instruments are assigned, the series of the MIDI messages belongs to the base part.

When the other instruments are assigned, the classifying unit 302 determines an average height of a sound range of the series of the MIDI messages. When the average height is below a specific level, it is determined that the series of the MIDI messages belongs to the base part. When the average height is above a specific level, it is determined that the series of the MIDI messages belongs to the melody part.

In this process, the average height of a sound range may be replaced with a deviation of a variance in a length of a musical note. In this case, when the deviation is below a specific level, it is determined that the series of the MIDI messages belongs to the base part. When the deviation is above a specific level, it is determined that the series of the MIDI messages belongs to the melody part.

After the classification of the parts, the processing units 305 to 305 execute a conversion process of the series of the MIDI messages.

When it is determined that the series of the MIDI messages belongs to the melody part in step S402, the chord processing unit 303 converts a number of chords of the series of the MIDI messages (step S403). An optimal number of chords is determined according to the characteristic of the speaker of the cellular phone 120. The optimal number may be determined in advance and stored in, for example, a data base for processing melody conversion in the hard disk 112 (see FIG. 2). When the MIDI data has an empty channel, the series of the MIDI messages may be copied in the empty channel, so that the number of chords can be doubled. When the MIDI data does not have an empty channel, the series of the MIDI messages may be added to a channel corresponding to the series of the MIDI messages, so that the number of chords can be doubled. Note that a total number of chords does not exceed a maximum number of chords that a sound generator in the cellular phone 120 can generate.

When it is determined that the series of the MIDI messages belongs to the rhythm part in step S402, the velocity processing unit 304 converts a velocity of the series of the MIDI messages (step S404). The velocity of the series of the MIDI messages corresponding to the rhythm part may be converted to, for example, a maximum number (127). An optimal velocity is determined according to the characteristic of the speaker of the cellular phone 120. The optimal velocity may be determined in advance and stored in, for example, a data base for processing velocity conversion (not shown) in the hard disk 112.

When it is determined that the series of the MIDI messages belongs to the base part in step S402, the sound range processing unit 305 shifts a sound range of the series of the MIDI messages (step S405). In order to shift the sound range, a note of each of the MIDI messages (a number representing a scale) may be changed. An amount of the shift of the sound range may be determined according to the characteristic of the speaker. An optimal amount of the shift (or a sound range after the shift) may be determined in advance and stored in, for example, a data base for processing sound range conversion (not shown) in the hard disk 112.

After the sound range is shifted, the MIDI data editing program determines that the channel of the series of the MIDI messages is the last channel (step S406). When it is determined to be not the last channel, the MIDI data editing program executes a process for the series of the MIDI messages corresponding to a next channel. When it is determined to be the last channel, the MIDI data editing program re-organize a MIDI file using the series of the MIDI messages after the conversions. Finally, the MIDI data editing program stores the re-organized MIDI file in the RAM 115, thereby completing the editing process (step S408).

In the conversion processes (step S403 to S405) described above, the number of chords, the velocity, and the sound range are converted according to the parts. It is possible to convert them for emphasizing one of the parts in addition to the conversion processes. For example, it is possible to further adjust a specific instrument in the channel according to the characteristic of the speaker of the cellular phone 120. It is also possible to copy a harmonic of the series of the MIDI messages (one octave higher pitch) to an empty channel, or apply a de-tune process (process in which a series of MIDI messages with a sound range shifted by several percentages is copied in an empty channel), so that a small speaker produces profound sound. Further, it is possible to apply a process of increasing a master volume, a channel volume, or master expression to increase a volume.

In the embodiments, the channel number is used for determining the rhythm part. Alternatively, a type of instrument, a deviation of a variance in a length of a musical note, and the like may be used for determining the rhythm part.

In the embodiments, the series of the MIDI messages is classified into the melody part, the rhythm part, and the base part. The names of the parts do not necessarily match to musical concepts of melody, rhythm, and base. It is suffice that the series of the MIDI messages is classified into a part suitable for the chord number conversion process (step S403 in FIG. 3), a part suitable for the velocity conversion process (step S404 in FIG. 3), and a part suitable for the sound range shift conversion process (step S405 in FIG. 3).

As described above, according to the embodiments of the present invention, the system 100 can determine the method of converting the MIDI messages according to the channel associated with the part. Accordingly, it is possible to effectively edit the MIDI data according to a characteristic of a speaker.

The disclosure of Japanese Patent Application No. 2004-152922, filed on May 24, 2004, is incorporated in the application.

While the invention has been explained with reference to the specific embodiments of the invention, the explanation is illustrative and the invention is limited only by the appended claims.

What is claimed is:

1. A play data editing device for editing play data according to a characteristic of a speaker, comprising:

a dividing unit for dividing first play data into second play data per channel;

a classifying unit for classifying the second play data into a rhythm part, a melody part, and a base part, said classifying unit determining that the second play data corresponding to a tenth channel belongs to the rhythm part;

a chord processing unit for converting a number of chords of the second play data corresponding to the melody part according to the characteristic of the speaker;

a velocity processing unit for converting a velocity of the second play data corresponding to the rhythm part according to the characteristic of the speaker; and a sound range processing unit for shifting a sound range of the second play data corresponding to the base part according to the characteristic of the speaker.

2. A play data editing device according to claim 1, wherein said classifying unit determines that the second play data belongs to the base part when an assigned instrument of the second play data is a predetermined base instrument.

3. A play data editing device according to claim 1, wherein said classifying unit determines that the second play data belongs to the melody part when an assigned instrument of the second play data is a predetermined melody instrument.

4. A play data editing device according to claim 1, wherein said classifying unit determines that the second play data belongs to the base part when an average height of the sound range of the second play data is below a specific level, and determines that the second play data belongs to the melody part when the average height is above the specific level.

5. A play data editing device according to claim 1, wherein said classifying unit determines that the second play data belongs to the base part when a deviation of a variance in a length of a musical note in the second play data is below a specific level, and determines that the second play data belongs to the melody part when the deviation is above the specific level.

6. A method of editing play data according to a characteristic of a speaker, comprising the steps of:

dividing step of dividing first play data into second play data per channel;

classifying step of classifying the second play data into a rhythm part, a melody part, and a base part so that it is determined that the second play data corresponding to a tenth channel belongs to the rhythm part;

chord conversion step of converting a number of chords of the second play data corresponding to the melody part according to the characteristic of the speaker;

velocity conversion step of converting a velocity of the second play data corresponding to the rhythm part according to the characteristic of the speaker; and sound range conversion step of shifting a sound range of the second play data corresponding to the base part according to the characteristic of the speaker.

7. A method according to claim 6, wherein, in said classifying step, it is determined that the second play data belongs to the base part when an assigned instrument of the second play data is a predetermined base instrument.

8. A method according to claim 6, wherein, in said classifying step, it is determined that the second play data belongs to the melody part when an assigned instrument of the second play data is a predetermined melody instrument.

9. A method according to claim 6, wherein, in said classifying step, it is determined that the second play data belongs to the base part when an average height of the sound range of the second play data is below a specific level, and determines that the second play data belongs to the melody part when the average height is above the specific level.

10. A method according to claim 6, wherein, in said classifying step, it is determined that the second play data belongs to the base part when a deviation of a variance in a length of a musical note in the second play data is below a specific level, and determines that the second play data belongs to the melody part when the deviation is above the specific level.

* * * * *